US009540964B2

(12) United States Patent
Kim

(10) Patent No.: US 9,540,964 B2
(45) Date of Patent: Jan. 10, 2017

(54) VARIABLE VALVE TIMING CAMSHAFT

(71) Applicant: Hyundai Motor Company, Seoul (KR)

(72) Inventor: Hyounghyoun Kim, Hwaseong-Si (KR)

(73) Assignee: Hyundai Motor Company, Seoul (KR)

( * ) Notice: Subject to any disclaimer, the term of this patent is extended or adjusted under 35 U.S.C. 154(b) by 64 days.

(21) Appl. No.: 14/542,588

(22) Filed: Nov. 15, 2014

(65) Prior Publication Data

US 2015/0167506 A1 Jun. 18, 2015

(30) Foreign Application Priority Data

Dec. 17, 2013 (KR) ..... 10-2013-0157594

(51) Int. Cl.

| | |
|---|---|
| ***F01L 1/34*** | (2006.01) |
| ***F01L 1/344*** | (2006.01) |
| *F01L 1/02* | (2006.01) |
| *F01L 1/047* | (2006.01) |
| *F01L 1/053* | (2006.01) |

(52) U.S. Cl.

CPC ..... *F01L 1/3442* (2013.01); *F01L 1/026* (2013.01); *F01L 2001/0473* (2013.01); *F01L 2001/0537* (2013.01); *F01L 2001/34456* (2013.01)

(58) Field of Classification Search

CPC .. F01L 1/026; F01L 1/3442; F01L 2001/0473; F01L 2001/0537; F01L 2001/34456

USPC ..... 123/90.15, 90.17

See application file for complete search history.

(56) References Cited

U.S. PATENT DOCUMENTS

2011/0197839 A1* 8/2011 Yoshika et al.

* cited by examiner

*Primary Examiner* — Ching Chang

(74) *Attorney, Agent, or Firm* — Morgan, Lewis & Bockius LLP

(57) ABSTRACT

A variable valve timing camshaft which may be connected to a continuous variable valve timing apparatus having a rotor and a stator which are adapted to relatively rotate with each other and may be operated so as to vary open/close timing of valve may include a non-control camshaft coupled to the continuous variable valve timing apparatus, having a first drive gear rotating together with the rotor and a second drive gear rotating together with the stator, and rotating according to rotation of an engine without varying a phase along a circumferential direction, a control camshaft having an outer shaft rotating according to one of the first drive gear or the second drive gear, an inner shaft rotating according to the other of the first drive gear or the second drive gear, an outer cam, and an inner cam and a limiting device limiting end play of the inner shaft.

4 Claims, 8 Drawing Sheets

VARIABLE VALVE TIMING CAMSHAFT

CROSS-REFERENCE TO RELATED APPLICATION

The present application claims priority to Korean Patent Application No. 10-2013-0157594 filed Dec. 17, 2013, the entire contents of which is incorporated herein for all purposes by this reference.

BACKGROUND OF THE INVENTION

Field of the Invention

The present invention relates to a variable valve timing camshaft. More particularly, the present invention relates to a variable valve timing camshaft which is adapted to vary open/close timing of a valve.

Description of Related Art

Generally, an intake valve which is selectively opened or closed so as to supply fuel for combustion and an exhaust valve which is selectively opened or closed so as to exhaust exhaust gas formed by the combusted fuel are provided in a combustion chamber of an engine.

The determining of open/close timing of the valve (intake valve or exhaust valve) may depend on a shape of a cam, rotation speed of a camshaft, and so on.

In detail, the cam rotates together with the camshaft to drive the valve, and the camshaft rotates by receiving torque from an engine. In addition, the time from when opening of the valve is started to when closing of the valve is ended and the lift of the valve are determined according to the shape of the cam, and the time from when opening of the valve is started to when closing of the valve is ended and the repetition cycle of opening/closing the valve are determined according to the rotation speed of the camshaft.

The rotation speed of the camshaft is generally proportional to the rotation speed of the engine. In addition, the optimally required open/close timing of the valve is varied according to the rotation speed of the engine. Therefore, it is required that the open/close timing of the valve is suitably varied according to the rotation speed of engine. Particularly, output and fuel consumption of the engine can be improved and simultaneously exhaust gas can be decreased if the open/close timing of the intake valve is suitably varied according to driving conditions including the rotation speed of the engine.

Meanwhile, the open/close interval between valves which are respectively disposed at combustion chambers which are provided in the engine may be determined by a phase difference along a circumferential direction between cams which open/close each valve.

An apparatus for controlling the open/close timing of the valve is one such as a continuous variable valve timing (CVVT) apparatus. In addition, the CVVT apparatus is operated to control the rotation speed of the camshaft and vary a phase difference along a circumferential direction between the cams.

However, reactivity or durability may be deteriorated if a connection structure with or composition of the CVVT apparatus for controlling the open/close timing of the valve and the camshaft is complex. In addition, interference with surrounding devices may occur.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a variable valve timing camshaft having advantages of having a simple composition and connection structure with a continuous variable valve timing apparatus, and simultaneously improving operating performance.

In addition, various aspects of the present invention are directed to providing a variable valve timing camshaft having further advantages of improving the connection structure with a CVVT apparatus and durability thereof.

According to various aspects of the present invention, a variable valve timing camshaft which may be connected to a continuous variable valve timing apparatus having a rotor and a stator which are adapted to relatively rotate with each other and may be operated to vary open/close timing of valve may include a non-control camshaft being coupled to the continuous variable valve timing apparatus, having a first drive gear rotating together with the rotor and a second drive gear rotating together with the stator, and rotating according to rotation of an engine without varying a phase along a circumferential direction, a control camshaft having an outer shaft rotating according to one of the first drive gear or the second drive gear, an inner shaft rotatably inserted into the outer shaft and rotating according to the other of the first drive gear or the second drive gear, an outer cam fixed to the outer shaft, and an inner cam fixed to the inner shaft, and adapted such that a phase along a circumferential direction is varied between the outer shaft and the inner shaft according to relative rotation of the rotor and the stator, and a limiting device limiting end play of the inner shaft.

The limiting device may be coupled with the inner cam, and the limiting device may include a limiting pin penetrating the outer shaft along a radial direction so as to be coupled with the inner shaft, and a limiting pin hole formed at the outer shaft such that the limiting pin penetrates it, in which an axial direction width of the limiting pin hole may be formed to be close in size to a diameter of the limit pin.

When at least two inner cams are disposed, the limit pin may be disposed at one of the at least two inner cams, and one limiting pin hole may be formed such that the limit pin is coupled thereto.

The limiting device may include a locking pin adapted to penetrate the outer shaft along a radial direction and to be inserted into the inner shaft, a locking groove formed along an external circumference of the inner shaft such that the locking pin is inserted thereto, and a locking pin hole formed at the outer shaft such that the locking pin penetrates the outer shaft.

The locking pin may be fixed to the locking pin hole.

A diameter of the locking pin hole may be formed to be smaller than a diameter of the locking pin, and the locking pin may be forcibly inserted into the locking pin hole.

An axial direction width of the locking groove may be formed to be close in size to a diameter of the locking pin.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
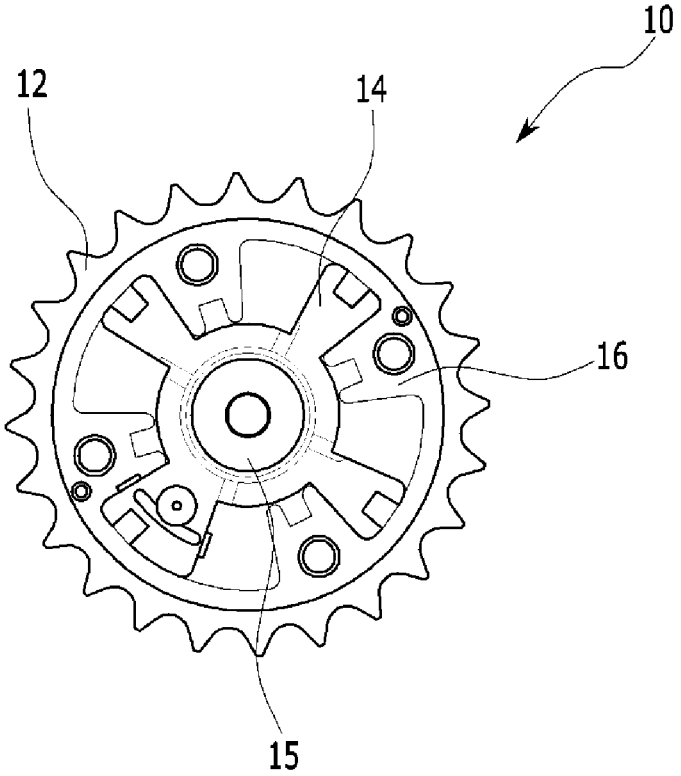
FIG. 1 is a schematic diagram of a basic continuous variable valve timing apparatus which is connected with an exemplary variable valve timing camshaft according to the present invention.

FIG. 1 is a schematic diagram of a basic continuous variable valve timing apparatus which is connected with a variable valve timing camshaft according to various embodiments of the present invention.

As shown in FIG. 1, the continuous variable valve timing (CVVT) apparatus 10 basically includes a rotor 15, a stator 16, and a vane 14. In addition, a gear or a chain sprocket 11 may be mounted at the CVVT apparatus 10.

The gear or the chain sprocket 11 is connected with a gear or a sprocket by a member such as a belt or a chain rotating together with a crankshaft so as to synchronize rotation of an engine and rotation of a variable valve timing camshaft 1. Hereinafter, the gear or the chain sprocket 11 will be called a chain sprocket 11.

One of the rotor 15 and the stator 16 composing the CVVT apparatus 10 is fixed to the chain sprocket 11 so as to be driven by rotation of the engine, and the other of the rotor 15 and the stator 16 is driven by a hydraulic pressure type of control apparatus or an electrical control apparatus. Therefore, the rotor 15 and the stator 16 relatively rotate with each other according to the operation of the CVVT apparatus 10.

Figure 2A:
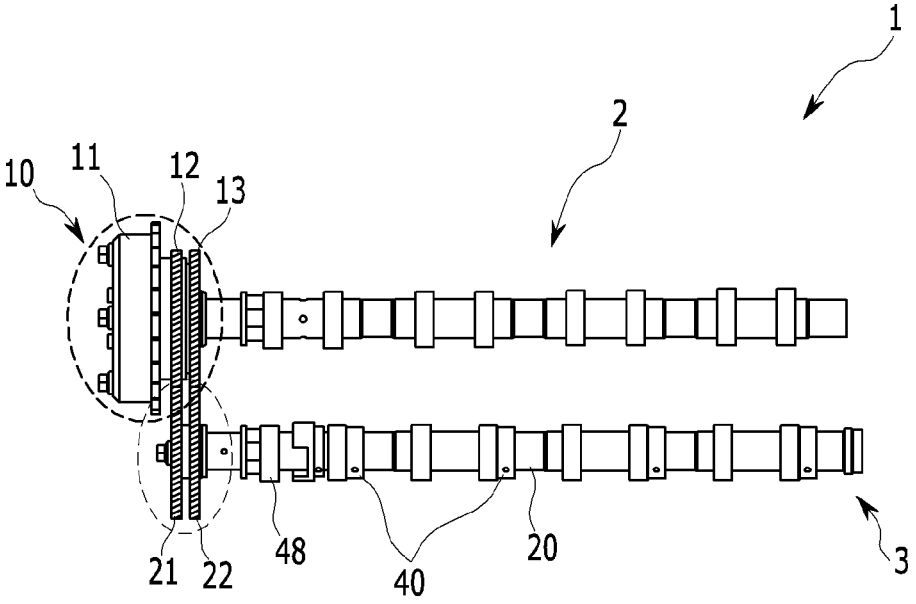
FIG. 2A, FIG. 2B, and FIG. 2C are drawings which show a connection structure of the exemplary variable valve timing camshaft and the continuous variable valve timing apparatus according to the present invention.
Figure 2B:
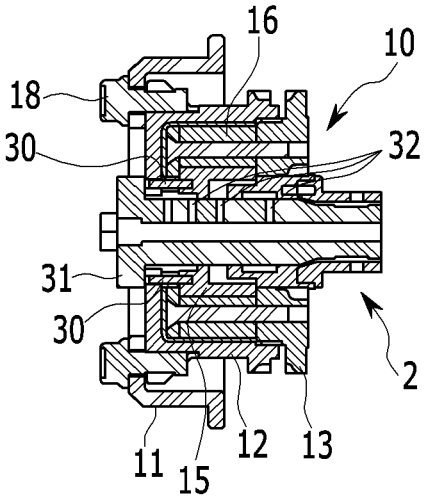
Figure 2C:
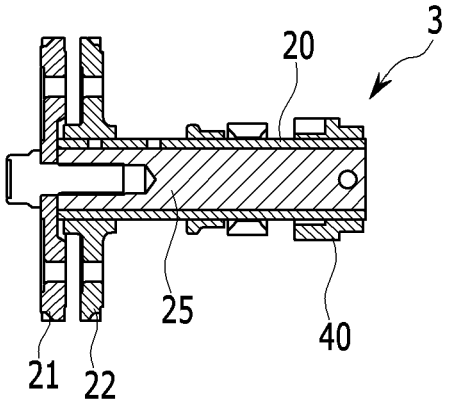
Figure 3A:
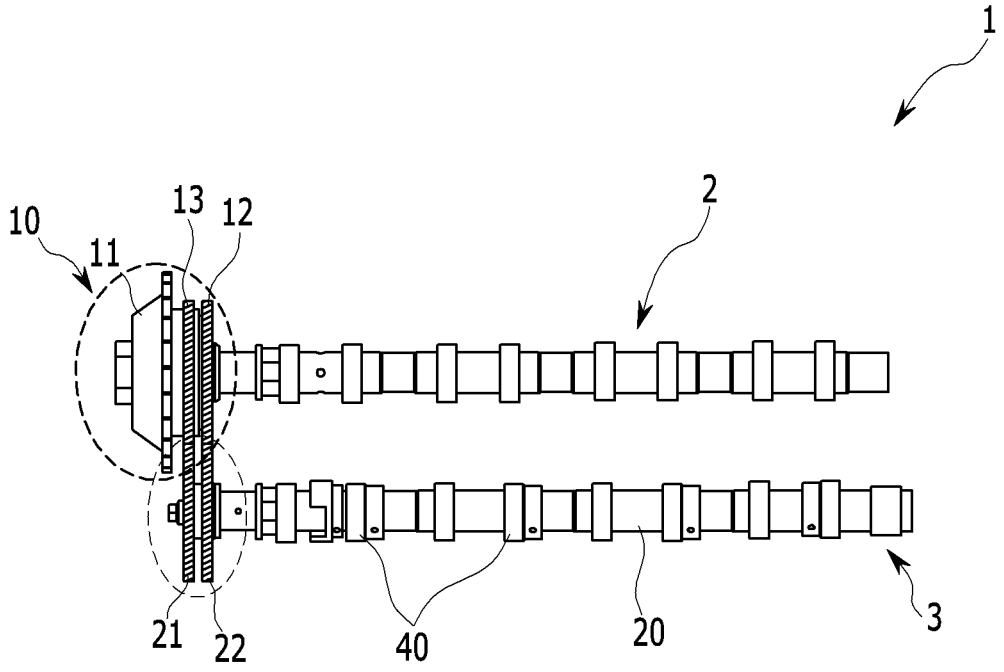
FIG. 3A, FIG. 3B, and FIG. 3C are drawings which show a connection structure of an exemplary variable valve timing camshaft and a continuous variable valve timing apparatus according to the present invention.
Figure 3B:
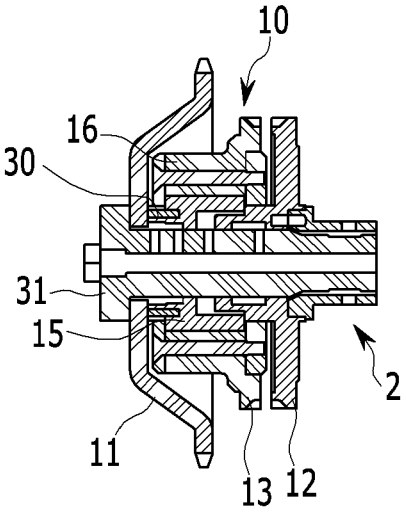
Figure 3C:
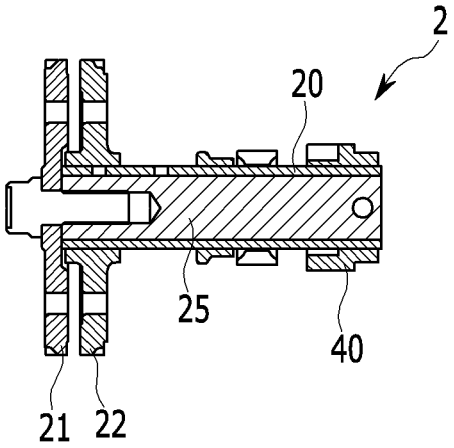

The one of the rotor 15 and the stator 16 is coupled with an outer shaft 20 of the variable valve timing camshaft 1, and the other of the rotor 15 and the stator 16 is coupled with an inner shaft 25 of the variable valve timing camshaft 1 (Referring to FIG. 2C and FIG. 3C). That is, the CVVT apparatus 10 is connected with the variable valve timing camshaft 1. Therefore, a relative phase along a circumferential direction of the outer shaft 20 and the inner shaft 25 may be varied according to the operation of the CVVT apparatus 10.

FIG. 2A, FIG. 2B, and FIG. 2C are drawings which show a connection structure of a variable valve timing camshaft and a continuous variable valve timing apparatus according to various embodiments of the present invention.

As shown in FIG. 2A, FIG. 2B, and FIG. 2C, the variable valve timing camshaft 1 includes a non-control camshaft 2 and a control camshaft 3, and the CVVT apparatus 10 includes the chain sprocket 11 in a connection structure with the variable valve timing camshaft 1 according to various embodiments of the present invention and the CVVT apparatus 10.

The non-control camshaft 2 is coupled with the chain sprocket 11 rotating according to rotation of an engine so as to rotate together therewith, and is not operated to vary open/close timing of a valve. The CVVT apparatus 10 is coupled with the non-control camshaft 2.

The control camshaft 3 is a camshaft-in-camshaft. The camshaft-in-camshaft includes the outer shaft 20 and the inner shaft 25. In addition, the outer shaft 20 is formed with a hollow cylindrical shape, and the inner shaft 25 is inserted into the hollow of the outer shaft 20 so as to be concentrically disposed with the outer shaft 20. Further, at least one of the outer shaft 20 and the inner shaft 25 may be rotated by a predetermined rotation angle with respect to the other such that a relative phase along a circumferential direction the outer shaft 20 and the inner shaft 25 can be varied. The basic composition of the camshaft-in-camshaft is well-known to a person of ordinary skill in the art, so a detailed description thereof will be omitted.

The control camshaft 3 includes the outer shaft 20, an outer cam 48 fixed to the outer shaft 20, the inner shaft 25 rotatably inserted into the outer shaft 20, and an inner cam 40 fixed to the inner shaft 25 and rotatably disposed on the outer shaft 20.

The control camshaft 3 is operated so as to vary at least one open/close timing of a valve which is opened or closed by the outer cam 48 and a valve which is opened or closed by the outer cam 48 according to a variation in a relative phase along a circumferential direction of the outer cam 48 and the inner cam 40.

The CVVT apparatus 10 includes the rotor 15 and the stator 16.

The one of the rotor 15 and the stator 16 can relatively rotate with respect to the other. In addition, the one of the rotor 15 and the stator 16 is gear-connected with the outer shaft 20, and the outer shaft 20 is rotated by rotation of the one of the rotor 15 and the stator 16. Further, the other of the rotor 15 and the stator 16 is gear-connected with the inner shaft 25, and the inner shaft 25 is rotated by rotation of the other of the rotor 15 and the stator 16.

The rotor 15 is adapted such that a first drive gear 12 is mounted thereto, and the stator 16 is adapted such that a second drive gear 13 is mounted thereto. The rotor 15 and the first drive gear 12 are coupled by a fixing pin 30 so as to rotate together. That is, the rotor 15 and the first drive gear 12 have equal phases along a circumferential direction.

The first drive gear 12 and the second drive gear 13 are respectively gear-connected with a first driven gear 21 which is mounted at one side of the inner shaft 25 and a second driven gear 22 which is mounted at one side of the outer shaft 20. Therefore, the rotor 15 is connected with the inner shaft 25 by the gear-connection, and the stator 16 is connected with the outer shaft 20 by the gear-connection.

The chain sprocket 11 is coupled to and fixed to the rotor 15 and the non-control camshaft 2 by a CVVT apparatus bolt 31. In addition, the chain sprocket 11 is coupled to and fixed to the first drive gear 12 by a chain sprocket bolt 18. Therefore, the rotor 15, the non-control camshaft 2, and the first drive gear 12 are driven according to rotation of the engine.

Hereinafter, operation in which open/close timing of a valve, which is operated by the control camshaft 3, is varied in a connection structure with the variable valve timing camshaft 1 and the CVVT apparatus 10 according to various embodiments of the present invention will be described.

The stator 16 relatively rotates with the rotor 15 by hydraulic pressure flowing in through an oil hole 32 which is formed at the CVVT apparatus bolt 31. Therefore, a relative phase along a circumferential direction of the rotor 15 and the stator 16 is varied.

A rotation ratio between the inner shaft 25 and the engine is not changed according to the rotor 15 being connected with the inner shaft 25 by the gear-connection of the first drive gear 12 and the first driven gear 21.

The phase of the outer shaft 20 is varied and open/close timing of a valve which is operated by the control camshaft 3 is varied according to the outer shaft 20 being connected with the stator 16 by the gear-connection of the second drive gear 13 and the second driven gear 22, and the stator 16 is operated by a hydraulic pressure type of control apparatus.

FIG. 3A, FIG. 3B, and FIG. 3C are drawings which show a connection structure of a variable valve timing camshaft and a continuous variable valve timing apparatus according to various embodiments of the present invention.

As shown in FIG. 3A, FIG. 3B, and FIG. 3C, dispositions of the first drive gear 12 and the second drive gear 13 in a connection structure with a variable valve timing camshaft and a continuous variable valve timing apparatus according to various embodiments of the present invention are changed to compare with the connection structure with the variable valve timing camshaft and the continuous variable valve timing apparatus according to various embodiments of the present invention. Therein, the first drive gear 12 is connected with the second driven gear 22 rotating together with the outer shaft 20, and the second drive gear 13 is connected with the first driven gear 21 rotating together with the inner shaft 25.

Hereinafter, operation in which open/close timing of a valve, which is operated by the control camshaft 3, is varied in a connection structure with the variable valve timing camshaft 1 and the CVVT apparatus 10 according to various embodiments of the present invention will be described.

The stator 16 relatively rotates with the rotor 15 by hydraulic pressure flowing in through the oil hole 32 which is formed at the CVVT apparatus bolt 31. Therefore, a relative phase along a circumferential direction of the rotor 15 and the stator 16 is varied.

A rotation ratio between the outer shaft 20 and the engine is not changed according to the rotor 15 being connected with the outer shaft 20 by the gear-connection of the first drive gear 12 and the second driven gear 22.

The phase of the inner shaft 25 is varied and open/close timing of a valve which is operated by the control camshaft 3 is varied according to the inner shaft 25 being connected with the stator 16 by the gear-connection of the second drive gear 13 and the first driven gear 21, and the stator 16 is operated by a hydraulic pressure type of control apparatus.

In other words, the connection structure of the variable valve timing camshaft 1 and the CVVT apparatus 10 according to various embodiments of the present invention is a type that varies the phase of the outer shaft 20, and the connection structure of the variable valve timing camshaft 1 and the CVVT apparatus 10 according to various embodiments of the present invention is a type that varies the phase of the inner shaft 25. Meanwhile, both the connection structure of the variable valve timing camshaft 1 and the CVVT apparatus 10 according to various embodiments of the present invention and the connection structure of the variable valve timing camshaft 1 and the CVVT apparatus 10 according to various embodiments of the present invention are adapted such that the CVVT apparatus 10 is coupled with the non-control camshaft 2 of the variable valve timing camshaft 1.

In the variable valve timing camshaft 1 in which the control camshaft 3 is not coupled with the CVVT apparatus 10, end play of the non-control camshaft 2 is limited by coupling a cam cap with the CVVT apparatus 10, and the end play of the outer shaft 20 of the control camshaft 3 is limited by the cam cap. However, an additional composition is required for limiting the end play of the inner shaft 25 of the control camshaft 3. Herein, the end play is play of a member such as a shaft that can move along an axial direction thereof.

Figure 4:
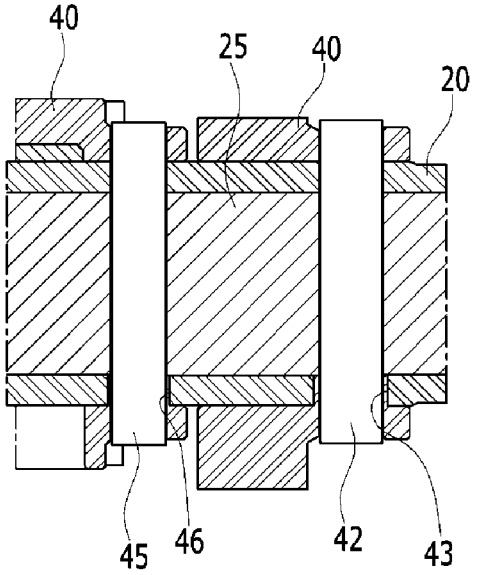
FIG. 4 is a drawing which shows a coupling structure of an inner cam of an exemplary variable valve timing camshaft according to the present invention.

FIG. 4 is a drawing which shows a coupling structure of an inner cam of a variable valve timing camshaft according to various embodiments of the present invention.

As shown in FIG. 4, the coupling structure of an inner cam of a variable valve timing camshaft according to various embodiments of the present invention includes a limiting pin 45 and a limiting pin hole 46.

At least one inner cam 40, which is provided to vary the phase thereof by varying the phase of the inner shaft 25, is disposed at an exterior circumference of the outer shaft 20. Herein, the outer cam 48 which varies the phase thereof by varying the phase of the outer shaft 20 is separately disposed with the inner cam 40 and is fixed to the outer shaft 20. In addition, the inner cam 40 is coupled to the inner shaft 25 by a connecting pin 42 so as to rotate together with the inner shaft 25.

The connecting pin 42 is coupled to the inner cam 40, and penetrates the outer shaft 20 along a radial direction so as to couple to the inner shaft 25. At this time, the outer shaft 20 has a connecting pin hole 43 such that the connecting pin 42 penetrates thereto.

The connecting pin hole 43 has a set length along a circumferential direction such that relative rotation of the outer shaft 20 and the inner shaft 25 is possible. Meanwhile, an axial direction width of the connecting pin hole 43 is formed to be longer than a diameter of the connecting pin 42 for smoothly operating. Thus, the end play of the inner shaft 25 occurs.

If the at least one inner cam 40 is two or more, the limit pin 45 is a pin such as the connecting pin 42 for mounting one of the two or more inner cams 40. In addition, the outer shaft 20 has the limiting pin hole 46 such that the limit pin 45 penetrates the outer shaft 20.

An axial direction width of the limiting pin hole 46 is formed to be close to a diameter of the limit pin 45 for limiting the end play of the inner shaft 25.

Figure 5:
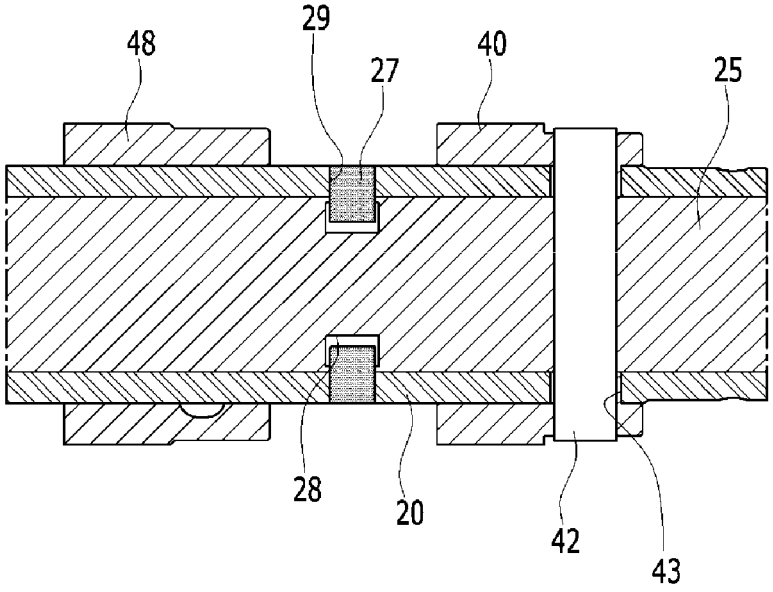
FIG. 5 is a drawing which shows a coupling structure of an inner cam of an exemplary variable valve timing camshaft according to the present invention.

FIG. 5 is a drawing which shows a coupling structure of an inner cam of a variable valve timing camshaft according to various embodiments of the present invention.

As shown in FIG. 5, the coupling structure of an inner cam of a variable valve timing camshaft according to various embodiments of the present invention includes a locking pin 27, a locking groove 28, and a locking pin hole 29.

The locking pin 27 penetrates the outer shaft 20 from an exterior circumference to the hollow along a radial direction, and is disposed to be inserted into the inner shaft 25.

The locking groove 28 is formed at the inner shaft 25 such that the locking pin 27 is inserted thereto. In addition, the locking groove 28 is formed along an external circumference of the inner shaft 25.

The locking pin hole 29 is formed at the outer shaft 20 such that the locking pin 27 penetrates the outer shaft 20. In addition, the locking pin 27 is fixed to the locking pin hole 29. For example, a diameter of the locking pin hole 29 may be formed to be smaller than a diameter of the locking pin 27, and the locking pin 27 may be forcibly inserted into the locking pin hole 29.

An axial direction width of the locking groove 28 is formed to be close to a diameter of the locking pin 27 for limiting the end play of the inner shaft 25.

According to various embodiments of the present invention, accuracy of the valve timing control may be better, and reactivity and operational efficiency may be improved. In addition, vibration and noise may be minimized, and durability may be ensured.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable valve timing camshaft which is connected to a continuous variable valve timing apparatus having a rotor and a stator which are adapted to relatively rotate with each other and is operated to vary open/close timing of a valve, the variable valve timing camshaft comprising:

a non-control camshaft coupled to the continuous variable valve timing apparatus, having a first drive gear rotating together with the rotor and a second drive gear rotating together with the stator, the non-control camshaft rotating according to rotation of an engine;

a control camshaft having an outer shaft rotating according to one of the first drive gear or the second drive gear, an inner shaft rotatably inserted into the outer shaft and rotating according to the other of the first drive gear or the second drive gear, an outer cam fixed to the outer shaft, and an inner cam fixed to the inner shaft, wherein a phase along a circumferential direction is varied between the outer shaft and the inner shaft according to relative rotation of the rotor and the stator; and a limiting device limiting end play of the inner shaft, wherein the limiting device includes:

a locking pin penetrating the outer shaft along a radial direction and to be inserted into the inner shaft;

a locking groove formed along an external circumference of the inner shaft such that the locking pin is inserted thereto; and a locking pin hole formed at the outer shaft such that the locking pin penetrates the outer shaft.

2. The variable valve timing camshaft of claim 1, wherein the locking pin is fixed to the locking pin hole.

3. The variable valve timing camshaft of claim 2, wherein a diameter of the locking pin hole is formed to be smaller than a diameter of the locking pin, and the locking pin is forcibly inserted into the locking pin hole.

4. The variable valve timing camshaft of claim 1, wherein an axial direction width of the locking groove is formed to be approximately in size to a diameter of the locking pin.

* * * * *